United States Patent [19]

Godwin

[11] 4,365,698

[45] Dec. 28, 1982

[54] MULTIPLE DISCHARGE CHUTE

[75] Inventor: Jerry L. Godwin, Hagerstown, Md.

[73] Assignee: Kennecott Corporation, Stamford, Conn.

[21] Appl. No.: 199,360

[22] Filed: Oct. 21, 1980

[51] Int. Cl.[3] ..... B65G 11/00

[52] U.S. Cl. ..... 193/2 B

[58] Field of Search ..... 193/2 R, 2 B, 2 C, 2 D, 193/4, 5, 23, 14, 29; 198/533; 222/564

[56] References Cited

U.S. PATENT DOCUMENTS 1,709,604 4/1929 Boywton ..... 222/564

*Primary Examiner*—John J. Love

*Assistant Examiner*—Gene A. Church

*Attorney, Agent, or Firm*—R. Lawrence Sahr

[57] ABSTRACT

This disclosure relates to a discharge chute for granular material which is associated with an apparatus wherein the apparatus is vibrated with the vibrations also being imparted to the discharge chute. It has been found that in such instances, the capacity of the discharge chute may be greatly increased by providing more than one sloping wall while at the same time not increasing the overall height of the discharge chute. Further, when the angle of the sloping wall above the sloping bottom wall is increased, the capacity of that wall is greatly increased.

9 Claims, 5 Drawing Figures

MULTIPLE DISCHARGE CHUTE

This invention relates in general to new and useful improvements in chutes, and more specifically to a discharge chute for granular material, such as sand.

This invention particularly relates to a discharge chute which is associated with a vibrating tub and vibrates generally vertically together with such tub. In order that the load height of the tub may be as low as reasonable to minimize installation costs and facilitate operation, it also is desirable to have the discharge height of the tub as low as possible. Accordingly, with such as installation it is not practical to make the bottom of a discharge chute as steep as is required for the desired granular material flow. This invention relates to the solution of this problem.

It is to be understood that the discharge chute receives granular material from a housing portion over an elongated area. Thus some of the granular material will engage the upper part of the bottom wall and move all the way down while others will tend to gather on the bottom wall further down. The net result is that if the bottom wall is permitted to receive all of the granular material being discharge from the housing, the lower portion of the chute become overloaded.

It has been found that if the maximum depth of a granular material on the chute sloping wall is on the order of the vertical dimension of the vibratory movement of the chute, a most effective flow of the granular material down the chute can be effected.

In accordance with this invention, it is proposed to solve the problem of an overloaded chute by providing a second sloping wall of the chute, the second sloping wall being disposed above the sloping chute bottom wall and being positioned to receive a portion of the discharge from the housing. In this way the flow of the granular material out of the housing is divided to the two sloping surfaces so that without any additional height the capacity of the discharge chute may be doubled.

It has also been found that it is feasible to add more than one intermediate sloping wall so that, depending upon the length of the discharge area of the housing, one or more additional sloping walls may be mounted within the chute so that the chute may have three or more sloping walls for directing the granular material out of the discharge opening.

While it would appear that the simplest and most advantageous arrangement would be to have the sloping walls parallel, it has been found that where the sloping bottom wall of the chute has a rather shallow slope, if the overlying sloping wall is inclined at a greater angle, it will have a much greater carrying capacity. With the bottom wall slope being relatively shallow, by increasing the angle of the next sloping wall 4 degrees, the capacity of that wall may be double that of the bottom wall. Therefore, in accordance with this invention, it is preferable that the sloping walls other than the bottom wall be at a greater angle to the horizontal. It is feasible with a sloping bottom wall and a second sloping wall for the bottom wall to carry only one third of the discharge of the discharge chute with the other sloping wall carrying two thirds of the discharge due to the greater angle and thus the greater capacity.

With the above, and other objects in view that will hereinafter appear, the nature of the invention will be more clearly understood by reference to the following detailed description, the appended claims and the several views illustrated in the accompanying drawings.

Figure 1:
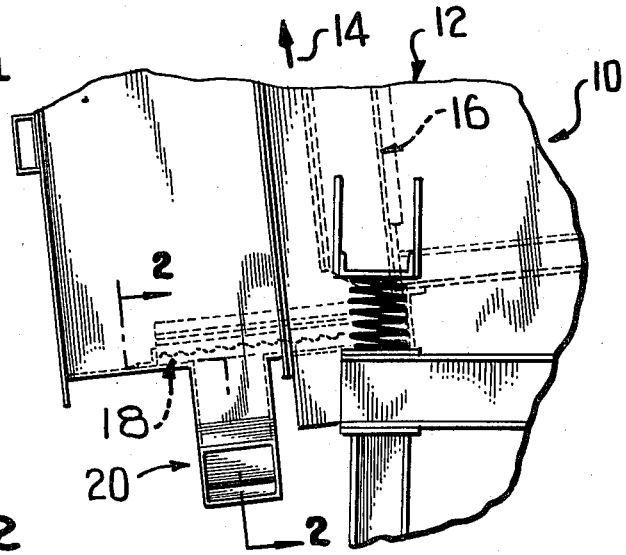
FIG. 1 is a schematic fragmentary side elevational view of a sand lump crusher and shows generally the position of the discharge chute with respect to the screen assembly thereof.

Referring now to the drawings in detail, it will be seen that there is illustrated in FIG. 1 a portion of a sand lump crusher, generally identified by the numeral 10. The sand lump crusher 10 includes a tub generally identified by the numeral 12. It is to be understood that the tub 12 has associated therewith vibratory means (not shown) which will affect the vibration of the tub 12 in a generally vertical direction, as indicated by the arrow 14.

The tub 12 has a rear wall assembly 16 which is constructed to abrade and discharge reusable sand particles and to separate such sand particles from scrap, fines and sand lumps. Sand passing through the rear wall arrangement 16 passes into a screen assembly 18 and reclaimed sand granules are discharged into a discharge chute 20 for collection. This invention relates to the construction of the discharge chute 20.

Figure 3:
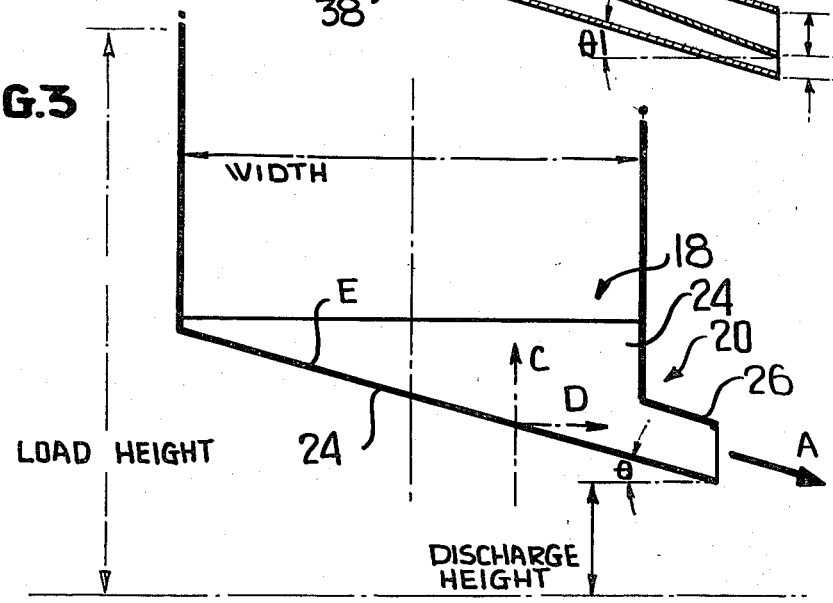
FIG. 3 is a schematic sectional view showing force components on the chute bottom wall due to the vibration of the discharge chute.

Reference is next made to FIG. 3 wherein there is illustrated a discharge chute 20 which includes an upper elongated housing portion 22 having a downwardly sloping bottom wall 24. The bottom wall 24 terminates in a generally rectangular cross sectional discharge portion 26.

Since the vibrating force on the tub conveying motion is parallel to the center line of the tub and at a right angle to the discharge direction (A), the flow in the discharge chute 20 is a combination of gravity due to the slope angle ($\theta$) of the chute and the vertical vibration (C) which tends to keep the particles in motion. This vertical vibration imparts a small sidewise force (D). These combined forces at a given angle ($\theta$) result in a flow volume on surface (E) of the bottom wall 24.

It is to be understood that one way to increase the flow in the chute 20 is to increase the slope angle ($\theta$). However, this is not desirable because it would increase the overall height of the sand lump crusher.

Figure 4:
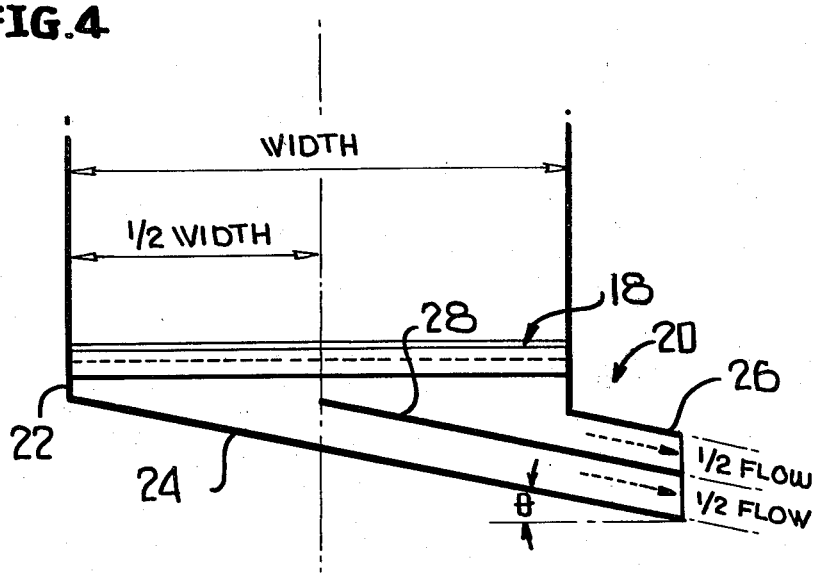
FIG. 4 is a vertical sectional view similar to FIG. 2 but taken through a modified form of discharge chute.

Reference is now made to FIG. 4 wherein one solution to the slope angle is shown. In the discharge chute arrangement 20 of FIG. 3, all of the granular material (sand) discharging from the housing 22 for the full length thereof fell onto the bottom wall 24. In accordance with this invention, it is proposed to provide a second sloping wall 28. The sloping wall 28 begins generally at the plane of the bottom of the housing 22 and at the center of the housing 22 and slopes downwardly and to the right in parallel overlying relation to the bottom wall 24. It will be understood that the sloping wall 28 will be spaced above the bottom wall 24 sufficient for unimpeded flow of granular material down the sloping bottom wall 24.

It will be noted that the bottom wall 24 now receives one half of the discharge from the housing 22. Thus the discharge from the housing 22 is equally divided onto the sloping bottom wall 24 and the sloping second wall 28. Since the right part of the housing 22 no longer discharges onto the bottom wall 24, the flow along the bottom wall 24 is no longer inhibited as it would be in the case of overloading and the capacity of the discharge chute 20 is doubled.

Figure 5:
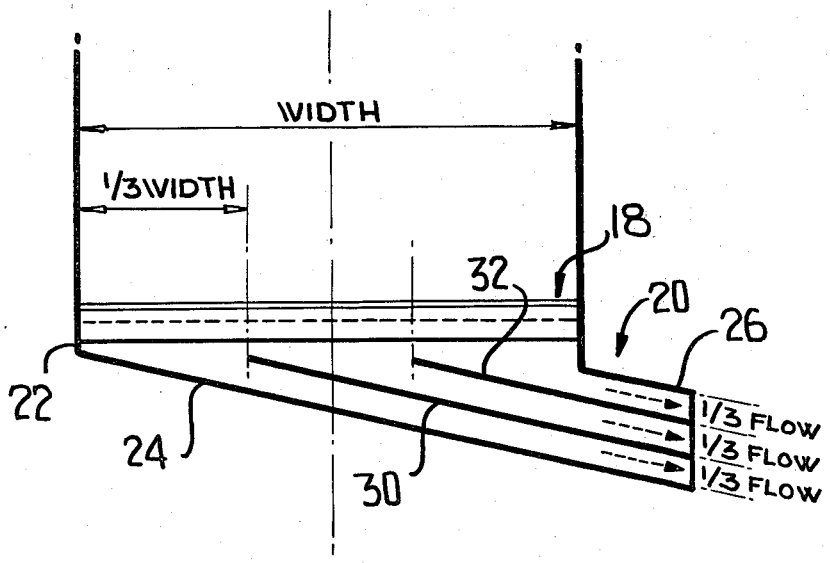
FIG. 5 is another fragmentary sectional view similar to FIG. 2 showing still another modified chute construction.

Reference is now made to FIG. 5 wherein there is illustrated another form of discharge chute 20. In this form of the discharge chute 20, there are two sloping walls 30 and 32 overlying the sloping bottom wall 24. The second sloping wall 30 begins at approximately the third point of the length of the housing 22 and continues down through the discharge part of the chute. The third sloping wall 32 starts at the two thirds point and extends down through the discharge portion 26. In the illustrated embodiment of the invention, the sloping walls 30, 32 are disposed parallel to one another and to the sloping bottom wall 24.

It will be readily apparent from the illustration of FIG. 5 that the sloping bottom wall 24 now receives only one third of the discharge from the housing 22 and the associated screen assembly 18. In a like manner, the second sloping wall 30 receives the middle third of the discharge from the screen assembly 18. The third sloping wall 32 receives the final one third of the discharge.

It will be seen that without increasing the height of the chute 20, in effect the capacity of the chute 20 may be tripled.

Although only a maximum of three sloping surfaces for discharging the granular material out of the discharge chute 20 has been illustrated, it is to be understood that the number could be increased even greater depending upon the effective length of the housing 22.

Figure 2:
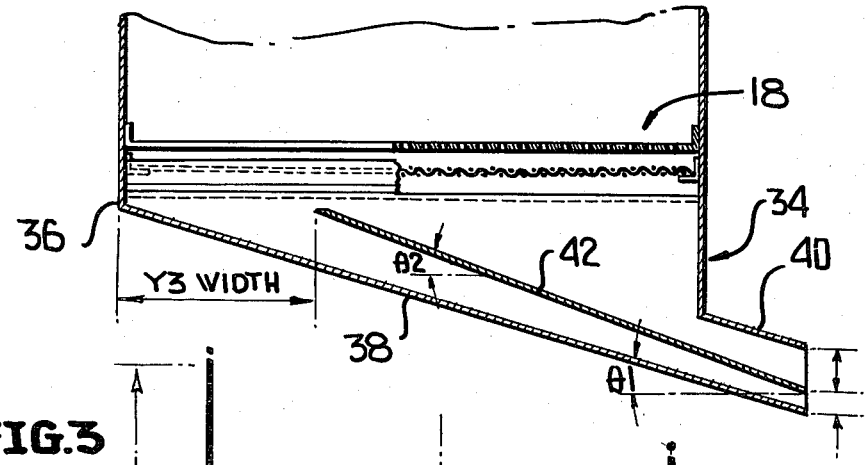
FIG. 2 is an enlarged fragmentary vertical sectional view taken generally along the line 2—2 of FIG. 1.

Although the discharge chute embodiments of FIGS. 4 and 5 have proven to be quite successful, it has been found that even more unobvious results have been obtained with a discharge chute arrangement 34 illustrated in FIG. 2. The discharge chute 34 is suspended from the screen assembly 18 and includes an upper generally rectangular cross sectional housing 36. It also includes a sloping bottom wall 38 which terminates in a discharge portion 40.

It is to be noted that the slope of the bottom wall 38 is relatively shallow and is at an angle ($\theta 1$) to the horizontal. It has been found that when this angle is relatively shallow, as is illustrated, and there is provided a second sloping wall 42, and the angle of slope of this wall is increased above that of the angle ($\theta 1$) on the order of 4 degrees so as to have an angle of $\theta 2$, the capacity of the sloping wall 42 will be approximately double that of the bottom wall 38. Accordingly, the sloping wall 42 may be positioned within the discharge chute 34, without increasing the height thereof, such that it receives two thirds of the discharge from the housing 36. Thus the effective capacity of the disharge chute arrangement 34 is equal to that of the discharge chute arrangement 20 having the two inner sloping walls 30, 32.

It is also feasible from a space standpoint to have still another sloping wall such as the wall 42. This wall will slope at an angle to the horizontal even greater than the angle 02 and will have a still greater capacity than the sloping wall 42. Such a discharge chute will have a very high capacity and will permit the overall slope of the chute to be held to a minimum thereby holding the discharge height to a minimum.

This concept can also be used for the discharge of material from oscillating or vibrating conveyors.

Although only several preferred embodiments of the discharge chute have been specifically illustrated and described herein, it is to be understood that minor variations may be made in the discharge chute other than those disclosed without departing from the spirit and scope of the invention as defined by the appended claims.

I claim:

1. A discharge chute operate to flow granular material therethrough, wherein said chute is, in operation, subjected to a continuous, generally vertical vibrating action, said chute comprising an upper housing portion adapted for receiving granular material, a bottom wall underlying said housing and extending lengthwise of said housing, said bottom wall starting at one end of said housing and sloping downwardly and generally towards the other end of said housing adapted for receiving granular material from a first portion of said housing, and at least one second sloping wall interposed between said bottom wall and said housing, said second wall starting at a point of said housing between said housing ends and sloping downwardly and generally towards said other end of said housing for receiving granular material from at least one second portion of said housing terminating at said housing other end, said bottom wall and said sloping second wall providing substantially increased flow capacity within substantially the same chute volume thereby permitting a lesser chute angle of slope, said first wall and said second wall being positioned such that the depth of granular material thereon is generally equivalent to the vertical dimension of said vibrating action.

2. The discharge chute of claim 1 wherein said chute has a discharge opening disposed beyond said housing other end.

3. The discharge chute of claim 1 wherein said second sloping wall slopes downwardly towards said bottom wall at an angle to said bottom wall, said second sloping wall being positioned to have a greater material flow volume capacity than said bottom wall.

4. The discharge chute of claim 3 wherein said second housing portion is greater than said first housing portion.

5. The discharge chute of claim 3 wherein said angle is about of 4 degrees or less.

6. The discharge chute of claim 3 wherein said angle is about 4 degrees or less, and said second housing portion is greater than said first housing portion.

7. The discharge chute of claim 1 wherein said second sloping wall is generally parallel to said bottom wall.

8. The discharge chute of claim 1 wherein said second sloping wall is generally parallel to said bottom wall, and said first and second housing portions being generally equivalent.

9. The discharge chute of claim 1 wherein said chute is part of a sand lump crusher.

* * * * *